US008404629B2

(12) United States Patent
De Pous

(10) Patent No.: US 8,404,629 B2
(45) Date of Patent: Mar. 26, 2013

(54) SAMPLING DEVICE FOR FLUID PRODUCTS

(75) Inventor: Olivier De Pous, Paris (FR)

(73) Assignee: Aptar France SAS, Le Neubourg (FR)

( * ) Notice: Subject to any disclaimer, the term of this patent is extended or adjusted under 35 U.S.C. 154(b) by 589 days.

(21) Appl. No.: 12/524,105

(22) PCT Filed: Jan. 18, 2008

(86) PCT No.: PCT/FR2008/050076

§ 371 (c)(1),
(2), (4) Date: Jul. 22, 2009

(87) PCT Pub. No.: WO2008/125757

PCT Pub. Date: Oct. 23, 2008

(65) Prior Publication Data

US 2010/0048449 A1 Feb. 25, 2010

(30) Foreign Application Priority Data

Jan. 23, 2007 (FR) ..... 07 52824

(51) Int. Cl.
*A61L 9/12* (2006.01)
*B67D 7/06* (2010.01)

(52) U.S. Cl. ..... 512/4; 222/423

(58) Field of Classification Search ..... 512/4; 222/423
See application file for complete search history.

(56) References Cited

U.S. PATENT DOCUMENTS

| | | | | |
|---|---|---|---|---|
| 4,487,801 | A * | 12/1984 | Turnbull et al. | 428/313.5 |
| 4,606,956 | A | 8/1986 | Charbonneau et al. | |
| 4,889,755 | A * | 12/1989 | Charbonneau | 428/40.2 |
| 4,925,517 | A * | 5/1990 | Charbonneau et al. | 156/276 |
| 5,391,374 | A * | 2/1995 | Charbonneau et al. | 424/401 |
| 5,445,821 | A | 8/1995 | Brown et al. | |
| 6,837,395 | B2 * | 1/2005 | Windorski et al. | 221/1 |

FOREIGN PATENT DOCUMENTS

WO 92/14607 A1 9/1992

* cited by examiner

*Primary Examiner* — Douglas McGinty
(74) *Attorney, Agent, or Firm* — Sughrue Mion, PLLC

(57) ABSTRACT

A fluid sample device comprising at least two superposed sheets (1, 2) that are connected together by a retaining element (3), each of the sheets including an inside face (1*a*, 2*a*), the inside faces (1*a*, 2*a*) facing each other in such a manner as to come into contact, the inside face (1*a*) of at least one sheet (1) including a zone (4) that is provided with microcapsules (4, 4') containing a fluid, the sample device being characterized in that the inside faces (1*a*, 2*a*) slide relative to each other with friction between a masked position and an exposed position of the zone (4) of microcapsules, being connected by the retaining element (3), in such a manner as to break the microcapsules and release the fluid contained therein progressively.

14 Claims, 3 Drawing Sheets

SAMPLING DEVICE FOR FLUID PRODUCTS

The present invention relates to a sample device for fluids, and more particularly a sample device of small thickness that is suitable for being inserted into a narrow space, in particular between the pages of a magazine, an envelope, or a prospectus, and that is also suitable for being kept, carried, and reused easily, independently of any supporting medium. The sample device is particularly well suited to fragrances, cosmetics, or pharmaceuticals.

Sample devices are already known for inserting into magazines. A sample device is generally a cardboard sheet that is folded in half and stuck together. The fluid, in general a fragrance, is situated directly inside the stuck-down zone of the paper. After opening the folded-down portion so as to expose the fragrance, the user, on bringing the opened zone up to the nose often initially smells the odor of the magazine paper, and then smells the fragrance only subsequently, however the fragrance is only short-lived or ends up by becoming spoilt when exposed to air, thus no longer producing the odors or properties of the original fluid, as would be preserved in a bottle. In order to solve that problem, such devices sometimes include microcapsules that make it possible to release the sampled fluid more progressively. The microcapsules are opened by peeling off a protective sheet.

Other sample systems are used that comprise a metal foil that is adhesively bonded at its periphery onto a paper supporting medium so as to confine therein a wipe that is folded and soaked in fragrance. Once the metal foil has been opened, the user can access the wipe, unfold it, and smell the fragrance therein. By using that type of sample device, the user, on taking the wipe, necessarily ends up with fingers covered in fragrance. In addition, the wipe is necessarily separate from the supporting medium and from the metal foil carrying advertising and references about the fluid. The wipe is thus generally lost, and even if it is kept by the user, no references about the fluid appear thereon. In addition, the fragrance tends to evaporate rather quickly from the wipe.

Furthermore, the page of advertising, regardless of whether it is cardboard and folded, or it includes a bonded-on metal foil, it is generally connected to the other pages of the magazine and provision is not made for the sample to be separated from the supporting medium for any subsequent use. Either way, it is not possible to separate the entire sample device from the supporting magazine. Thus, a user who wishes to remove both the sample and the references about the fluid, e.g. in order to take them to a shop so as to be certain of finding and purchasing the same fluid, or even in order to introduce the fluid to, and try it out on, another person, often needs to tear out the page containing the sample, supposing it if not desirable to take the entire magazine. Once opened, the sample no longer has the same appearance as before, and it also risks leaking, or at the very least spreading over a pocket or any other belonging carried in a bag.

An object of the present invention is to provide a fluid sample device that does not have the above-mentioned drawbacks.

In particular, an object of the present invention is to provide a fluid sample device that is thin in shape, that advantageously is suitable for being inserted, e.g. between the pages of a magazine, a prospectus, or an envelope, while being almost imperceptible from the outside, and that is easy for the user to use.

Another object of the present invention is to provide a fluid sample device that makes it possible to release the fluid progressively during its use, and that also enables the release of the fluid to be varied or sectorized, the user thus being able to choose not to release all of the sampled fluid at the same time.

Another object of the present invention is to provide a fluid sample device that facilitates the preservation of the sample by protecting the sample after use, and that completely preserves the properties of the sampled fluid.

Another object of the present invention is to provide a fluid sample device that may be separated easily and independently from the initial medium (magazine, prospectus, . . . ), that makes it possible subsequently to carry the sample device in safe, reliable, and very compact manner, and that makes reusing the device both practical and appealing.

Another object of the present invention is to provide a fluid sample device that is simple, that is inexpensive to manufacture and to assemble, that is easily fitted on or inserted into existing advertising media such as magazines, prospectus, tracts, envelopes, and that does not require major changes to those media.

To achieve these objects, the present invention proposes a fluid sample device comprising at least two superposed sheets that are connected together by a retaining element, each of the sheets including an inside face, the inside faces facing each other in such a manner as to come into contact, the inside face of at least one sheet including a zone that is provided with microcapsules containing a fluid, the sample device being characterized in that the inside faces slide relative to each other with friction between a masked position and an exposed position of the zone of microcapsules, being connected by the retaining element, in such a manner as to break the microcapsules and release the fluid contained therein progressively.

Advantageously, said faces slide by pivoting about the retaining element that thus acts as an axis of rotation or a pivot axis.

Advantageously, the sheets are movable, by sliding with friction, from an exposed position to a masked position, while being connected together at all times by the retaining element.

Advantageously, the device may include return means for returning the sheets to the masked position.

Advantageously, the device may include a plurality of zones of microcapsules, enabling the user to open and/or to protect the sample one or more times and/or in one or more locations. In an embodiment, a plurality of zones of microcapsules are disposed on a disk-shaped sheet with the retaining element being disposed centrally, the zone-free sheet including a window in which the zones can be positioned by turning the two sheets relative to each other.

Advantageously, at least one of the sheets includes a grip notch for taking hold of the other sheet that does not have a notch.

Advantageously, the device may include a holding element for holding the superposed sheets in the masked position.

Advantageously, the sheet provided with zones of microcapsules is disposed between two sheets forming a sleeve, the two sheets being connected together via at least one edge and advantageously by the retaining element.

Advantageously, the inside face of the sheet that rubs against the zone of microcapsules presents a surface quality that is rough or abrasive.

Advantageously, abrasion is greater in the direction going from the masked position towards the exposed position than in the opposite direction.

The present invention also defines a supporting medium including pages, such as a magazine, a prospectus, or an envelope, said supporting medium including a fluid sample device according to any preceding claim, inserted between its pages.

Advantageously, the sample device is fastened in removable manner to the supporting medium by means of at least one of its sheets, so as to enable the sample device to be carried and re-used separately from the supporting medium.

An advantageous principle of the present invention is to uncover the zone of microcapsules by means of a sliding action with friction, that can be likened to shearing. In the prior art, it is known to release the microcapsules by peeling, that can be likened to traction. Friction generated by sliding has an abrasive action on the microcapsules that are thus destroyed. The number of microcapsules opened is greater or smaller as a function both of the pressure applied during abrasion and of the duration of the abrasion. It is thus possible to modulate the opening the microcapsules, so as to release more or less fluid.

The sheets slide abrasively preferably while one sheet is pivoting relative to the other. However, it is not excluded to move the sheets in translation or axially relative to each other, in such a manner as to generate sliding with friction. Even with such a movement in translation or axially, the two sheets can be connected together by a retaining element providing it enables the two sheets to move axially relative to each other. For example, it is possible to imagine a sheet in the form of a card that is provided with one or more zones of microcapsules, that is engaged inside a sleeve, and that is connected to said sleeve by a retaining element that can advantageously act as resilient return means enabling the card to return inside the sleeve.

The invention is described more fully below with reference to the accompanying drawings that show several embodiments of the invention by way of non-limiting example.

The device of the present invention is for providing a fluid sample that can be a fragrance, a lotion, a cream, or any other cosmetic or pharmaceutical. The fluid is preferably a fragrance that releases an odor for smelling.

The device of the invention comprises at least four component elements, namely: at least two sheets 1, 2 that slide relative to each other with friction; a retaining element 3 that connects the sheets together; and at least one zone of microcapsules 4 disposed on one sheet and in contact with another sheet.

The microcapsules are small fragile capsules containing a fluid, e.g. a fragrance. By means of their barrier effect, the microcapsules isolate the fluid from the surrounding environment, and effectively protect the fluid from any degrading factor. The qualities of the fluid are thus good, preserved, and intact. When ruptured, the fluid is released. Naturally, the microcapsules can be replaced by any other impregnatable supporting material that is capable of retaining a fluid and of releasing it, e.g. under the effect of friction.

Figures 1, 2:
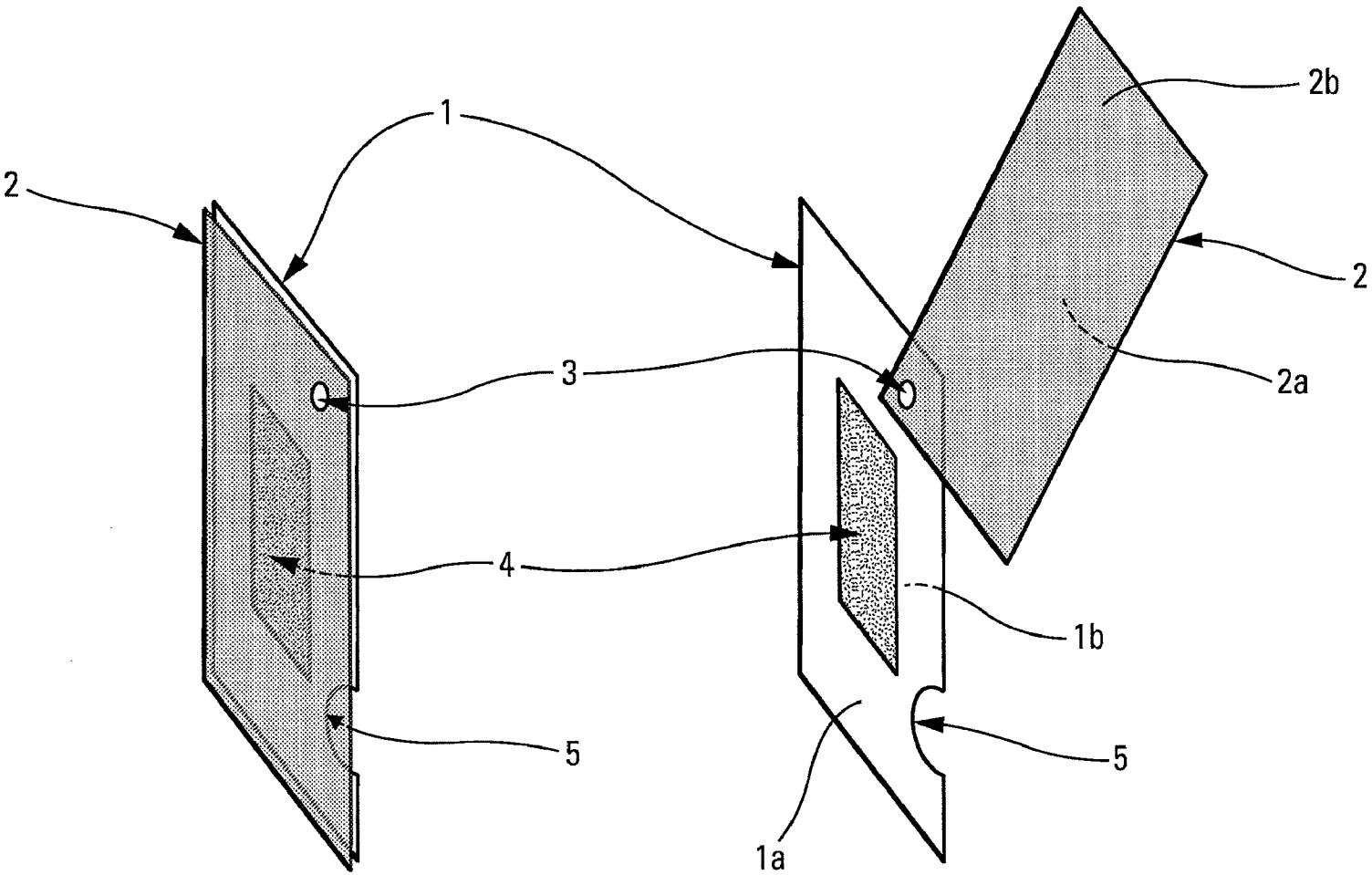
FIG. 1 is a diagrammatic perspective view of a fluid sample device constituting a first advantageous embodiment of the present invention in its masked or covered closed position, and including two sheets that are connected together in superposed manner in order to protect microcapsules (visible by transparency in the figure)
FIG. 2 is a view of the FIG. 1 device but this time in its exposed or uncovered open position, after sliding the two initially superposed sheets relative to each other in order to expose or free the zone of microcapsules that release the fragrance progressively.

The fluid sample device constituting the first advantageous embodiment of the invention is shown in FIG. 1 in its masked and protected closed position, and in FIG. 2 in its exposed or open position for enabling the microcapsules to release their contents; The sheets 1, 2 used can be of any type, of any material, and of any shape. The sheets are preferably thin. Each sheet comprises an inside face 1*a*, 2*a* and an outside face 1*b*, 2*b*, the inside faces facing each other and being in contact with each other. A zone 4 of microcapsules is applied to the inside face of sheet 1. In FIG. 1, the zone 4 is visible by transparency through sheet 2, and in FIG. 2, it is visible because it has been uncovered. The microcapsules may also be embedded in the material constituting the sheet or they may be form an integral portion of the composition of the sheet. The inside face 1*a* that presents the zone 4 of microcapsules is covered by the inside face 2*a* of the second sheet (shaded in FIGS. 1 and 2), in order to protect the microcapsules of the zone 4.

In this embodiment, the retaining element 3 that connects the two sheets together is a stud that is perpendicular to the two sheets. As shown in FIGS. 1 and 2, the stud connects the two sheets together in the proximity of a corner. Naturally, the retaining element 3 could be situated at any other location on the sheets, e.g. in the center. By being situated at a corner of the sheets, the retaining stud makes it possible, by sliding, slipping, or pivoting the sheets relative to each other, to uncover the entire zone 4 of microcapsules that is situated on sheet 1, as shown in FIG. 2.

Grip means can be provided to make it easier for the user to move the sheets relative to each other. For example, at least one of the sheets can include a notch or a grip cutout 5, so as to make it possible to take hold of the other sheet. In FIGS. 1 and 2, the notch 5 is made in sheet 1 that supports the zone 4 of microcapsules, so as to make it easier for the user to take hold of sheet 2 via said notch or cutout. When the user opens the sample device, i.e. slides sheets 1 and 2 relative to each other from the masked position (FIG. 1) to the exposed position (FIG. 2), the microcapsules are broken under the effects of sliding and of friction between the respective inside faces 1*a*, 2*a* of the two sheets. The microcapsules thus begin progressively to release their contents, e.g. a fragrance. Although in this embodiment the retaining element 3 is a stud, the retaining element that connects the sheets together could be of any other type: ribbon, paper, elastic, etc., providing it does not prevent the sheets from sliding relative to each other and from rubbing together.

In order to stop or slow down evaporation of the fragrance, it is easy to reposition the sheets as shown in FIG. 1, so as to mask the zone 4 of microcapsules once again. It suffices for the user to close the device in its masked position by sliding and pivoting the sheets relative to each other, either in the same direction as for opening, or in the opposite direction, with this being made possible by the retaining stud that is used both as a pivot, and as a permanent connection between the sheets.

The inside face 2*a* of the sheet 2 that rubs against the zone 4 of microcapsules may optionally be abrasive. It is possible for the inside face to be abrasive in the opening direction only, and non-abrasive in the opposite direction for closing the sample, thereby preserving the fluid by the microcapsules from release for as long as possible. Since the microcapsules are opened by friction or shearing, opening is much more progressive than it would be if it were done by peeling or traction. Depending on the quantity and the intensity of the friction, the user can select the degree to which the microcapsules are degraded and opened. The manufacturer can also make the inside face 2*a* abrasive to a greater or lesser extent depending on the speed desired for fluid release by the microcapsules. It should be observed that the abrasiveness of the inside face 2*a* makes it possible to keep the device in its closed or masked position.

The fluid sample device may include an element for repositioning the sheets automatically, i.e. a return element. This element may be a resilient return system or even a spring system, for example. The return element could also be constituted by the shape of the structure of the sheets themselves, or even by the retaining element 3. In the embodiments shown in the figures, a spring can be fitted on the pivot, so as to close the fluid sample device automatically if the user no longer holds it open.

The sample device of the invention may optionally be fastened to a supporting medium. The small thickness of the sample device makes it possible to insert it easily between the pages of a magazine, a book, a prospectus, an envelope, or any other narrow space, but it can also be fastened on any other supporting medium, e.g. a display. Because the sample device has a structure that is independent from the supporting medium, it can be fastened in removable manner to a supporting medium, e.g. advertising. One of the outside faces 1*b*, 2*b* of the device can be fastened by releasable adhesive on a magazine page. The fluid sample device can also be fastened by a ribbon, connecting together the sample and the supporting medium.

Even after use, the sample device of the invention, once closed, does not have the appearance of a used sample, but, on the contrary, it presents the same appearance as before it was opened. After being separated from the supporting medium, the sample of the invention can thus very easily be carried, kept, and even re-used by the user. For example, placed in a wardrobe, it can serve to freshen linen by means of its properties of releasing fragrance progressively and continuously by means of the microcapsules.

Figure 4:
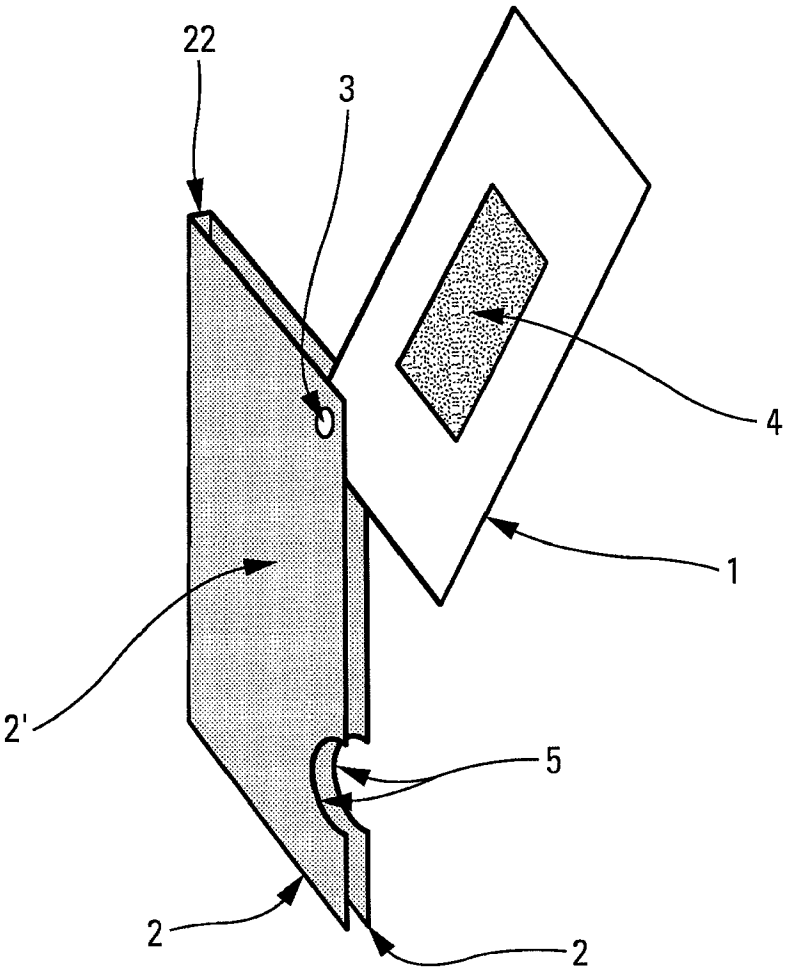
FIG. 4 is a view of the FIG. 3 device in its exposed or open position, after sliding the middle sheet between the outer sheets in order to unmask, expose, or free the zone of microcapsules.
Figure 3:
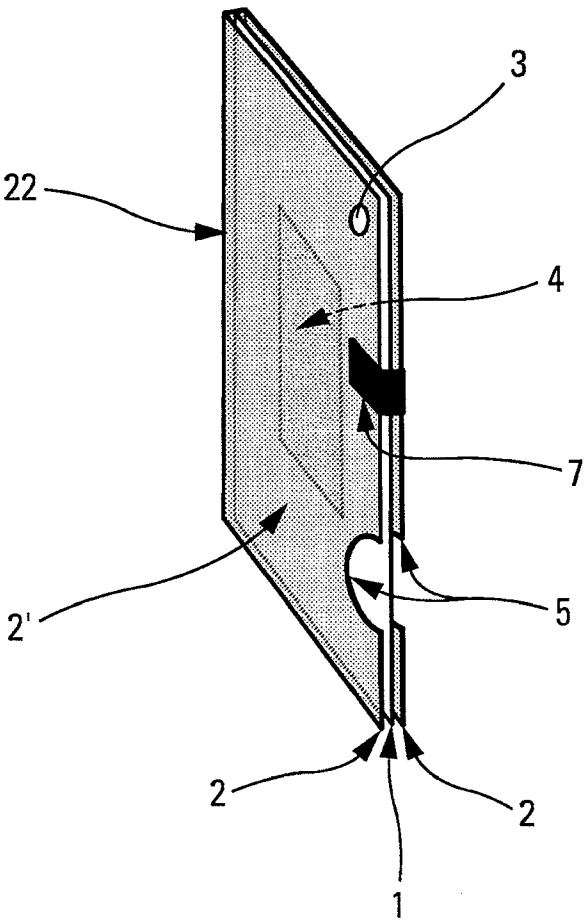
FIG. 3 is a diagrammatic perspective view of a fluid sample device constituting a second advantageous embodiment of the present invention in its masked or covered closed position, and including three sheets that are connected together in superposed manner, the outer sheets forming a sleeve for protecting the middle sheet that includes microcapsules.

FIGS. 3 and 4 show a second advantageous embodiment of the present invention, in which the sheet 2 that covers the sheet 1 supporting the zone 4 of microcapsules is configured in the form of a sleeve 2'. The sleeve can be formed by two sheets 2, 2 that are interconnected via an edge 22, as shown in FIGS. 3 and 4. The sleeve makes it possible to cover and to protect the central sheet 1 that includes the microcapsules 4. At least one of the inside faces of the sleeve can have the same role as the inside face la of the first embodiment. As in the first embodiment, the sleeve 2' and the central sheet 1 are held together permanently by a retaining stud 3 that passes through the sheets 1, 2 in the proximity of a corner. The sleeve makes it even safer to carry the sample, since it is better protected. Two superposed notches 5, i.e. a notch on each sheet 2 of the sleeve 2', enable the central sheet 1 to be accessed directly by the user, who can slide it out of the sleeve very easily. The sheet 1 can be provided with two zones 4 of microcapsules, e.g. a zone on each face. The inside faces of the sleeve can have the same abrading qualities as in the first embodiment.

A holding element 7 can be added for holding the sheet 1 in its sleeve (second embodiment) and/or for holding the sheets together (first embodiment). As shown in FIG. 3, it serves to hold the superposed sheets in the sleeve, i.e. in the protected closed position. In FIG. 3, the element is a tab 7 that releasably connects the two outside faces of the sleeve together, so as to prevent the inside sheet 1 from coming out of the sleeve between utilizations.

Figure 5:
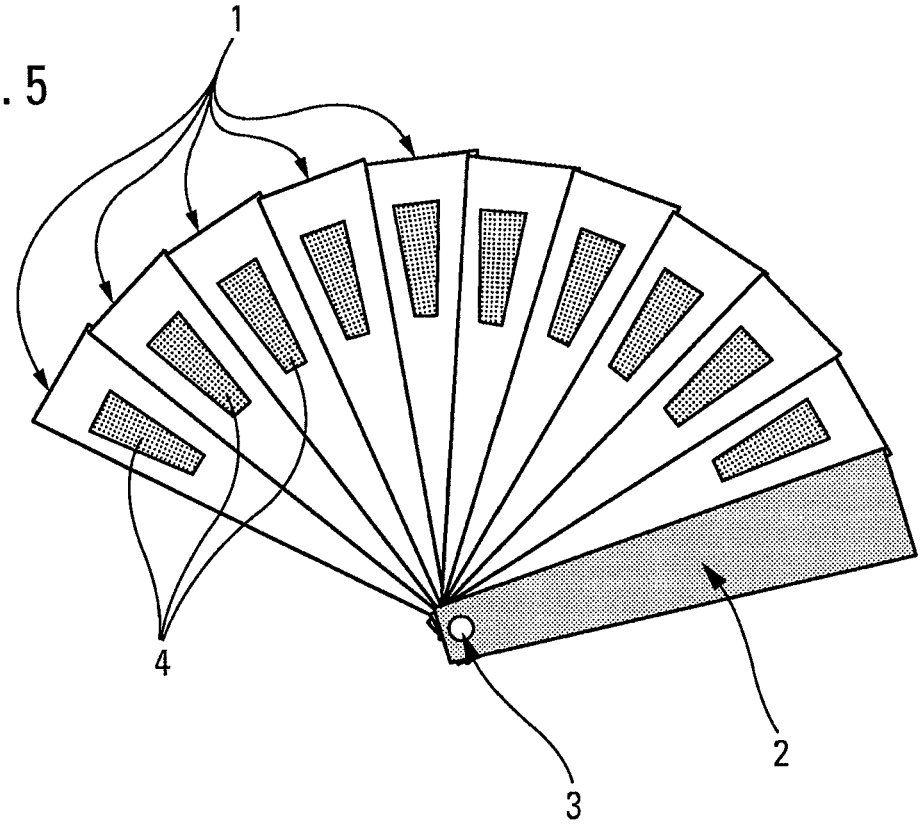
FIG. 5 is a diagrammatic plan view of a fluid sample device constituting a third embodiment of the present invention in its fan-like exposed or open position.

FIG. 5 shows a third embodiment of the fluid sample device of the present invention that involves superposing a plurality of sheets 1 (in this embodiment ten sheets), each sheet 1 including a zone 4 of microcapsules. Each of the intermediate sheets between the outermost sheet 1 and the sheet 2 presents one face with a covering of microcapsules and another face that rubs against the zone of microcapsules of the adjacent sheet. In its fully open state, the fluid sample device presents the shape of a fan. As shown in this embodiment, the fluid sample device of the invention can thus be sectorized into a plurality of zones of microcapsules. The user can thus choose to open all of the sample on a single occasion. However, the user can alternatively choose to open only a single portion of the sample, by sliding only some of the sheets against one another. The microcapsules of the various zones can optionally contain the same fluid. In this embodiment, the sample device can be carried easily and advantageously used as a fragranced fan.

Figure 6:
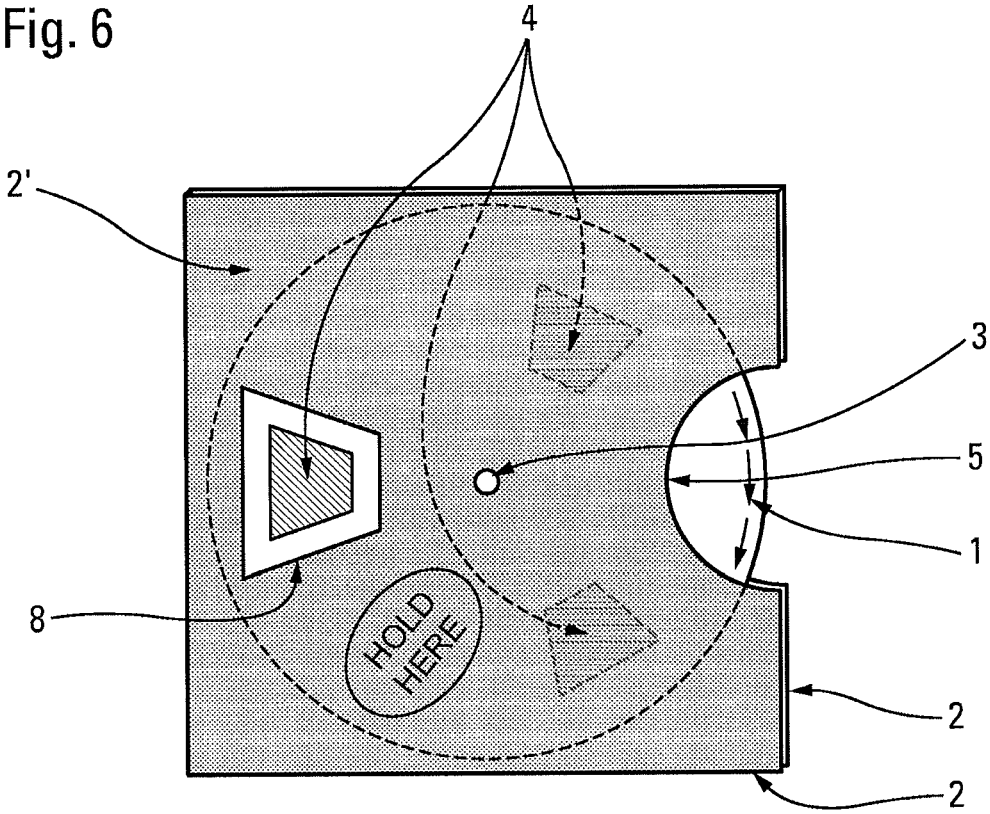
FIG. 6 is a diagrammatic plan view of a fluid sample device constituting a fourth embodiment of the present invention in the form of a rotary disk inside a sleeve.

In a fourth advantageous embodiment of the present invention shown in FIG. 6, the sample device includes a sheet 1 in the shape of a disk 1, with a plurality of zones 4 of microcapsules on at least one of its faces.

The disk is protected by a square sleeve 2' to which it is connected at its center by a retaining stud 3. The sleeve is formed by two sheets 2 that, in this embodiment, are connected together both along four edges, except for a pair of notches 5 provided in one edge of the sleeve, and advantageously also by the central retaining stud 3. The disk 1 projects from the sleeve in the notches 5, and can easily be gripped and turned about the retaining stud 3'.

The sleeve includes at least one window 8 via which the various zones 4 of microcapsules can be seen in succession, when the disk is turned. The inside face of the sleeve 2 including the window 8 rubs against the turning disk, and breaks the microcapsules 4, in a way similar to the abrasive inside face of the above-described embodiments. By way of example, the disk can indicate the recommended turning direction, and the sleeve can include a "hold-here" message on a location for pressing just in front of the window 8, so as to ensure that the zone 4 is rubbed sufficiently.

The device makes it possible to sectorize a single face of the sample into a plurality of zones of microcapsules that may contain different fluids. The device makes it easy for the user to compare the fluids released by each zone of microcapsules, while keeping the others protected by means of the sleeve closed along its four edges. The sample device can also be carried easily. Naturally, instead of the disk presenting microcapsules 4' on one face only, it could present them on both faces.

Thus, the fluid sample device of the invention combines reliability, durability, and good appearance with the sample, and the user is no longer tempted only to try out the sample, but is also tempted to keep it, to use it, and to re-use it, possibly until adopting the sampled fluid. The device thus fully achieves the role that a sample should achieve, in particular its advertising role.

Although the present invention is described above with reference to four particular embodiments, it is clear that various modifications could be applied thereto by a person skilled in the art, without going beyond the ambit of the present invention defined by the accompanying claims.

The invention claimed is:

1. A fluid sample device comprising:

a retaining element; and at least two superposed sheets connected together by the retaining element, each of the sheets including an inside face, the inside faces facing each other in such a manner as to come into contact, the inside face of at least one sheet including a zone that is provided with microcapsules containing a fluid;

wherein the inside faces, while the at least two superposed sheets remain connected together by the retaining element, slide relative to each other with friction between a masked position and an exposed position of the zone of microcapsules in such a manner as to break the microcapsules and release the fluid contained therein progressively.

2. A sample device according to claim 1, in which said faces slide by pivoting about the retaining element.

3. A sample device according to claim 1, in which the sheets (1, 2) are movable, by sliding with friction, from an exposed position to a masked position, while being connected together at all times by the retaining element (3).

4. A sample device according to claim 3, including return means for returning the zone to its masked position.

5. A sample device according to claim 1, including a plurality of zones (4) of microcapsules.

6. A sample device according to claim 5, in which a plurality of zones (4) of microcapsules are disposed on a disk-shaped sheet (1) with the retaining element (3) being disposed centrally, the zone-free sheet (2) including a window (8) in which the zones (4) can be positioned by turning the two sheets relative to each other.

7. A sample device according to claim 1, in which at least one of the sheets (1; 2) includes a grip notch (5) for taking hold of the other sheet that does not have a notch.

8. A sample device according to claim 1, further including a holding element (7) for holding the superposed sheets in the masked position.

9. A sample device according to claim 1, in which the sheet (1) provided with zones (4, 4') of microcapsules is disposed between two sheets (2) forming a sleeve (2'), the two sheets being connected together via at least one edge (22) and advantageously by the retaining element (3).

10. A sample device according to claim 1, in which the inside face (2*a*) of the sheet (2) that rubs against the zone (4) of microcapsules presents a surface quality that is rough or abrasive.

11. A sample device according to claim 10, in which abrasion is greater in the direction going from the masked position towards the exposed position than in the opposite direction.

12. A supporting medium comprising pages, such as a magazine, a prospectus, or an envelope, said supporting medium including a fluid sample device according to claim 1, inserted between its pages.

13. A supporting medium according to claim 12, in which the sample device is fastened in removable manner to the supporting medium by means of at least one of the sheets, so as to enable the sample device to be carried or re-used separately from the supporting medium.

14. A fluid sample device comprising:

a retaining element; and first and second superposed sheets pivotally connected together by the retaining element, an inside face of the first sheet facing and contacting an inside face of the second sheet;

the inside face of the first sheet comprising a zone comprising microcapsules comprising a fluid;

the first sheet and the second sheet pivotally retained to allow the inside face of the second sheet to relatively slide with friction against the inside face of the first sheet between a masked position of the zone and an exposed position of the zone, the friction resulting in breakage of the microcapsules;

the first sheet and the second sheet remain pivotally connected together by the retaining element during the sliding of the inside face of the second sheet relative to the inside face of the first sheet.

* * * * *